US007219454B2

(12) United States Patent
Maher

(10) Patent No.: US 7,219,454 B2
(45) Date of Patent: May 22, 2007

(54) ATTACHMENT SYSTEM

(75) Inventor: Patrick Gerard Maher, Kalgoorlie (AU)

(73) Assignee: Shark Abrasion Systems Pty. Ltd., Western Australia (AU)

( * ) Notice: Subject to any disclaimer, the term of this patent is extended or adjusted under 35 U.S.C. 154(b) by 794 days.

(21) Appl. No.: 10/343,787

(22) PCT Filed: Aug. 3, 2001

(86) PCT No.: PCT/AU01/00953

§ 371 (c)(1),
(2), (4) Date: Feb. 4, 2003

(87) PCT Pub. No.: WO02/12642

PCT Pub. Date: Feb. 14, 2002

(65) Prior Publication Data

US 2004/0060435 A1 Apr. 1, 2004

(30) Foreign Application Priority Data

Aug. 4, 2000 (AU) ..... PQ9168
Oct. 20, 2000 (AU) ..... PR0888

(51) Int. Cl.
*E02F 9/28* (2006.01)

(52) U.S. Cl. ..... 37/456; 172/753; 172/772.5; 403/31

(58) Field of Classification Search ..... 172/772, 172/772.5, 713, 753, 751, 272; 37/451–456, 37/458; 403/31, 34, 37, 379.5, 379.6
See application file for complete search history.

(56) References Cited

U.S. PATENT DOCUMENTS 5,579,594 A 12/1996 Pasqualini et al.
5,926,982 A * 7/1999 Keech et al. ..... 37/455

FOREIGN PATENT DOCUMENTS

AU 41363/85 10/1985
AU 74126/94 5/1995

* cited by examiner

*Primary Examiner*—Christopher J. Novosad
(74) *Attorney, Agent, or Firm*—Venable LLP; Robert Kinberg; Kavita B. Lepping

(57) ABSTRACT

An attachment system for connecting a first member such as a lip plate (12) of a mechanical digging device to a second member such as a ground engaging tool (10). The first member has a lug portion (22) attached thereto the second member has a recess (50) arranged, in use, about the lug portion. A clamping member (60) is disposed between the lug portion (22) and the second member (10) such that the supply of pressure to the clamping member (60) acts to restrain disengagement of the second member (10) from the lug portion (22).

25 Claims, 15 Drawing Sheets

ATTACHMENT SYSTEM

FIELD OF THE INVENTION

The present invention relates to an attachment system, particularly intended for the attachment of ground engaging tools to the lip plate of mechanical digging devices.

Many mining and earthmoving operation require the use of mechanical digging devices, such as front-end loaders. Such mechanical digging devices commonly feature buckets which can be manipulated by a user to dig into earth or rocks to be shifted. These buckets include a lip plate across the bucket floor. On this lip are mounted a series of ground engaging tools having a tooth-like appearance. These tools, in use, penetrate into the material being dug, and provide a leading edge for the bucket to follow.

The ground engaging tools are highly susceptible to wear due to the high level of friction generated by their use. Accordingly, it is often desirable to be able to remove a worn ground engaging tool and substitute a new tool.

A common method of attachment for ground engaging tools is that of welding. In practice, however, a welded ground engaging tool can be difficult to replace without substantial dismantling of the bucket.

Mechanical methods of attaching ground engaging tools through the use of restraining bolts and pins have been proposed. These methods are often difficult to use in practice, as the forces generated against a ground engaging tool can cause deformation of the bolt or pin, thus making subsequent disengagement difficult.

The present invention attempts to overcome at least in part some of the aforementioned disadvantages of previous attachment system for ground engaging tools.

SUMMARY OF THE PRESENT INVENTION

In accordance with one aspect of the present invention there is provided an attachment system for connecting a first member to a second member, characterised in that the first member has a lug connected thereto, and the second member has an aperture arranged, in use, about the lug and wherein a clamping member is disposed between the lug and the second member such that the supply of pressure to the clamping member acts to restrain disengagement of the second member from the lug.

BRIEF DESCRIPTION OF THE DRAWINGS

The present invention will now be described, by way of example, with reference to the accompanying drawings, in which.

DESCRIPTION OF THE INVENTION

Figure 1:
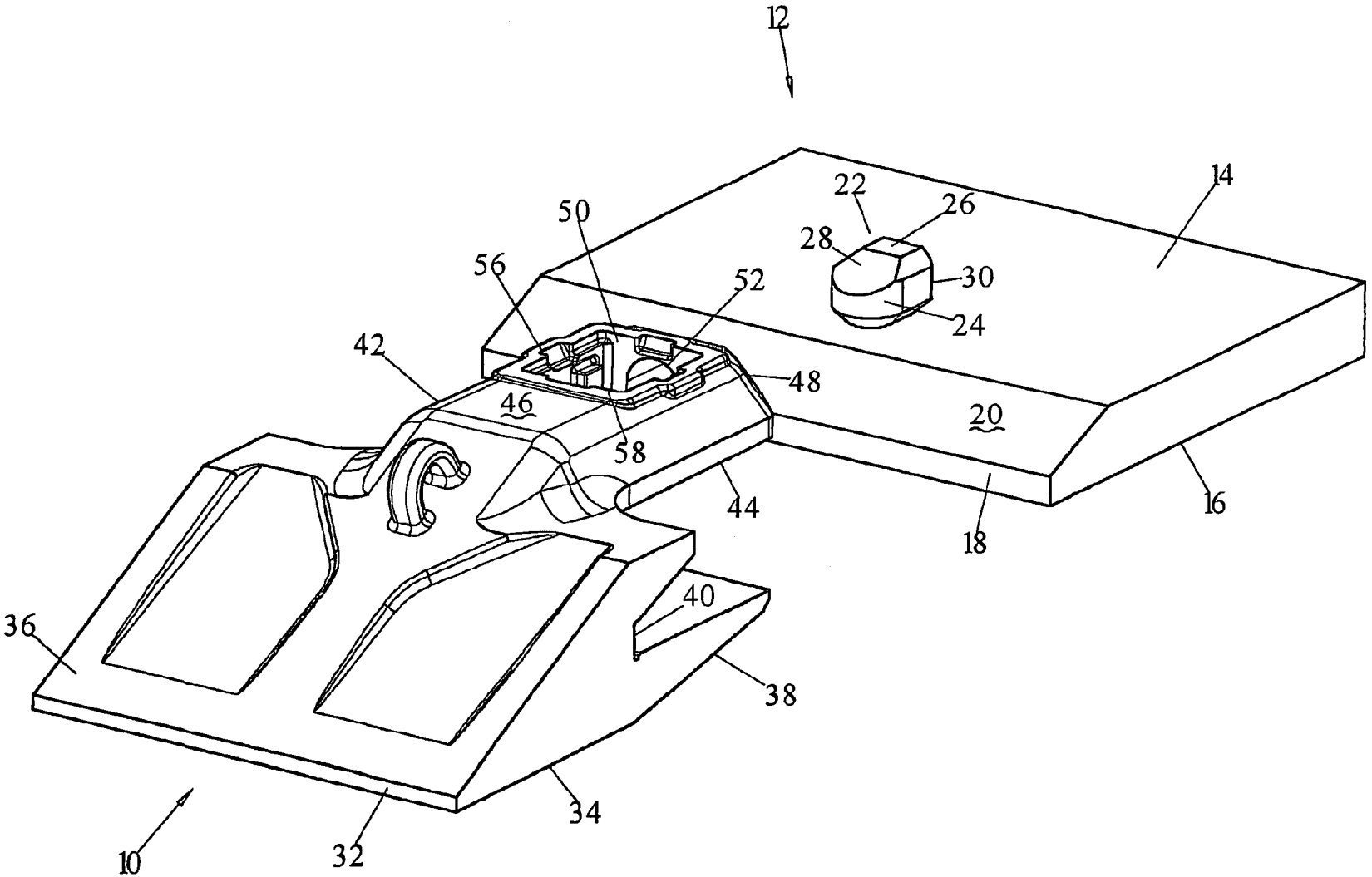
FIG. 1 is a perspective view of a ground engaging tool arranged to be attached to a lip plate (a portion of which is shown) in accordance with the present invention.
Figure 2:
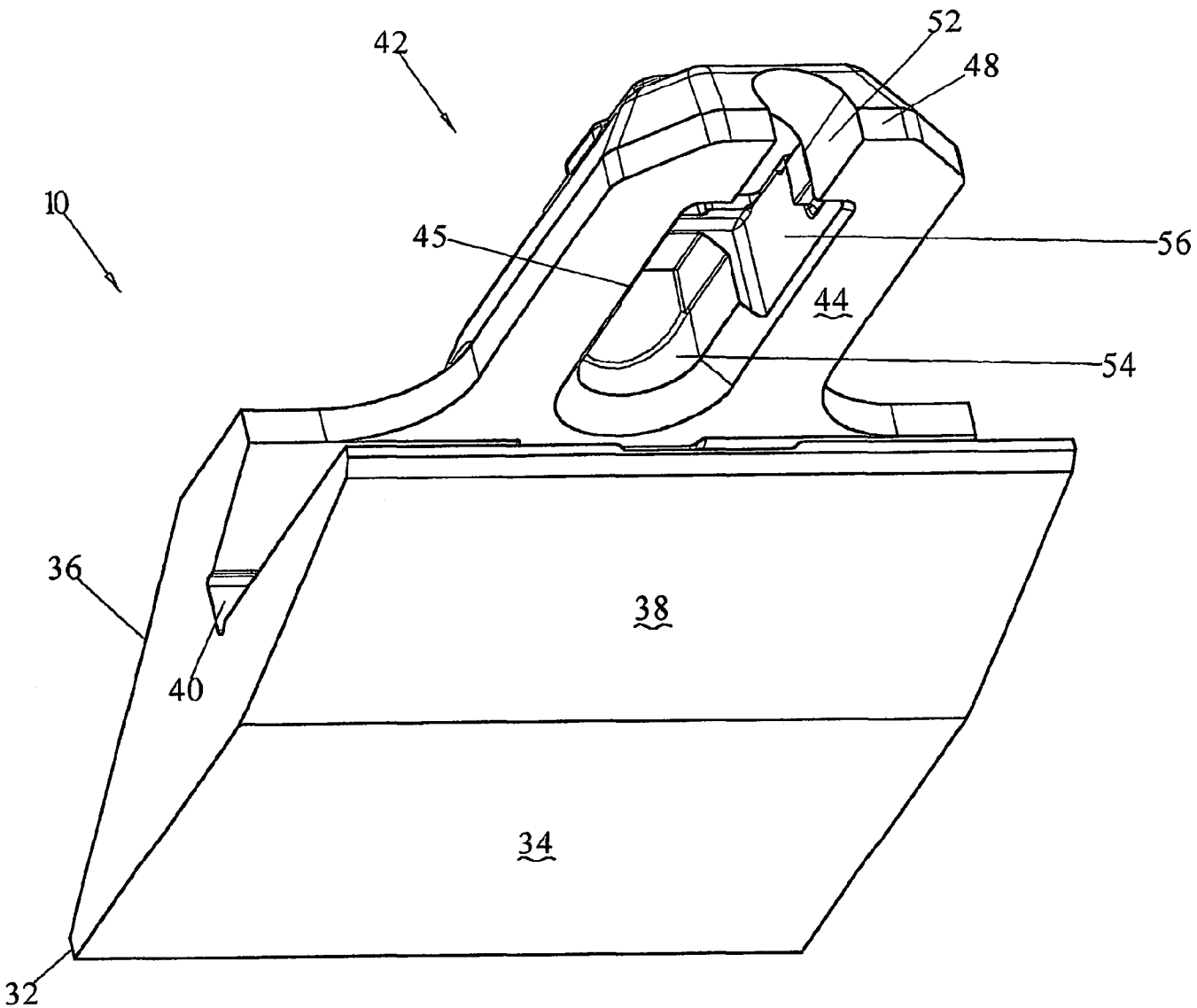
FIG. 2 is perspective view of the underside of the ground engaging tool of FIG. 1.

Referring to the Figures, there is shown a ground engaging tool 10 arranged to be attached to a portion of a lip plate 12. The lip plate 12 is substantially rectangular in cross section, and extends around the rim of a bucket (not shown) of a mechanical digging device. The lip plate 12 includes an upper face 14, a lower face 16 and an end face 18. A tapered surface 20 extends from the end face 18 of the lip plate 12 to the upper face 14.

The lip plate 12 includes a lug 22 affixed by suitable means (for instance welding) to the upper face 14. The lug 22 includes an elliptical prism portion 24 oriented towards the end face 18 of the lip plate 12, a top face 26 substantially parallel to the upper face 14 of the lip plate 12, a tapered surface 28 extending from the edge of the top face 26 to the edge of the elliptical prism portion 24 and a substantially flat rear face 30 oriented substantially perpendicularly to the upper face 14.

The ground engaging tool 10 comprises a leading edge 32, a first base portion 34 extending substantially perpendicularly of the leading edge 32, a front portion 36 extending away from the leading edge at a shallow angle, a second base portion 38 extending away from the first base portion 34 at a shallow angle, a transverse recess 40 disposed oppositely the leading edge 32 and an attachment portion 42. The front portion 36, leading edge 32 and the first base portion 34 co-operate to form a substantially V shaped working position in order to penetrate, in use, the material being dug. The transverse recess 40 is complementary in shape to the lip plate 12, and allows the ground engaging tool 10 to be located on the perimeter of the lip plate 12 adjacent the end face 18. The second base portion 38 tapers from the first base portion 34 in a direction away from the leading edge 32, and ends, in use, adjacent the lip-plate 12. The leading edge 32, first and second base portions 34 and 38 and the front portion 36 define a working portion of the ground engaging tool 10.

The attachment portion 42 extends from the front portion 36 adjacent the recess 40 in a direction away from the leading edge 32. It locates, in use, along the upper face 14 of the lip plate 12, and co-operates with the lug 22.

The attachment portion 42 has a substantially flat lower surface 44, a substantially flat upper surface 46 and a rear surface 48. The attachment portion 42 includes an engaging recess 50 extending inwardly of the rear surface 48 through a rear aperture 52 in the rear surface 48, and upwardly of the lower surface 44 through a lower aperture 45. The engaging recess has a first portion 54 remote from the rear aperture 52, and a second portion 56 adjacent the rear aperture 52. The first portion 54 is complementary in shape to the lug 22, whereas the second portion 56 is of larger transverse dimension than the first portion 54. This allows, in use, the second portion 56 to be placed about the lug 22. This in turn allows the attachment portion 42 to be slid over the lug 22 in a longitudinal direction, and to locate in a position whereby the lug 22 is within the first portion 54 of the engaging recess 50. In this position relative movement of the attachment portion 42 and the lip plate 12 in a transverse direction is restricted.

The attachment portion 42 further includes an aperture 58 within the upper surface 46. The aperture 58 communicates with the second portion 56 of the engaging recess 50. When the ground engaging tool is located such that the front of the lip plate 12 is engaged in the transverse recess 40 and the lug 22 is within the first portion 54 of the engaging recess 50, the aperture 58 is situated adjacent the rear face 30 of the lug 22.

Figure 3:
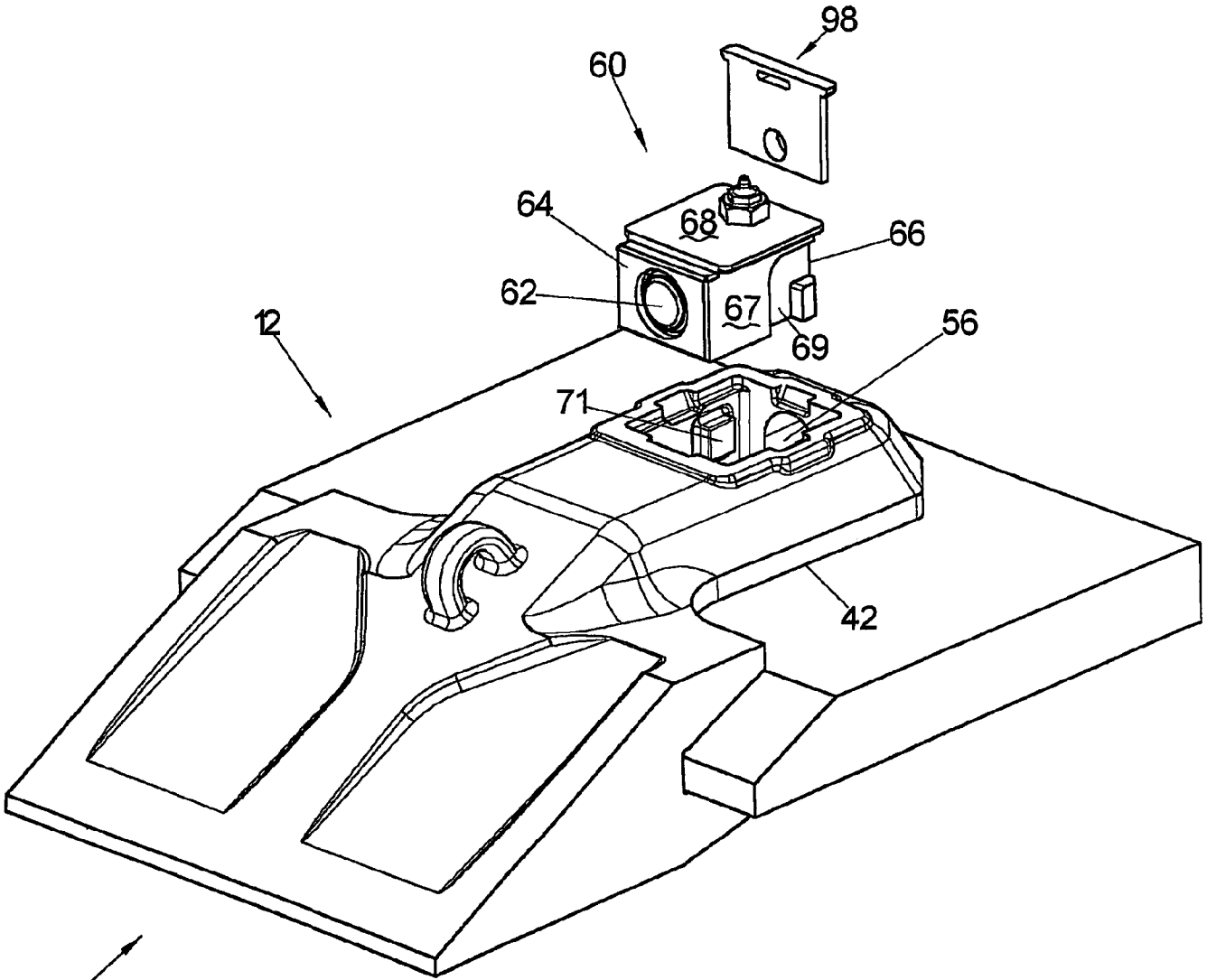
FIG. 3 is a perspective view of the ground engaging tool and lip plate portion of FIG. 1, shown during attachment, together with a clamping member in accordance with a first aspect of the present invention.
Figure 4:
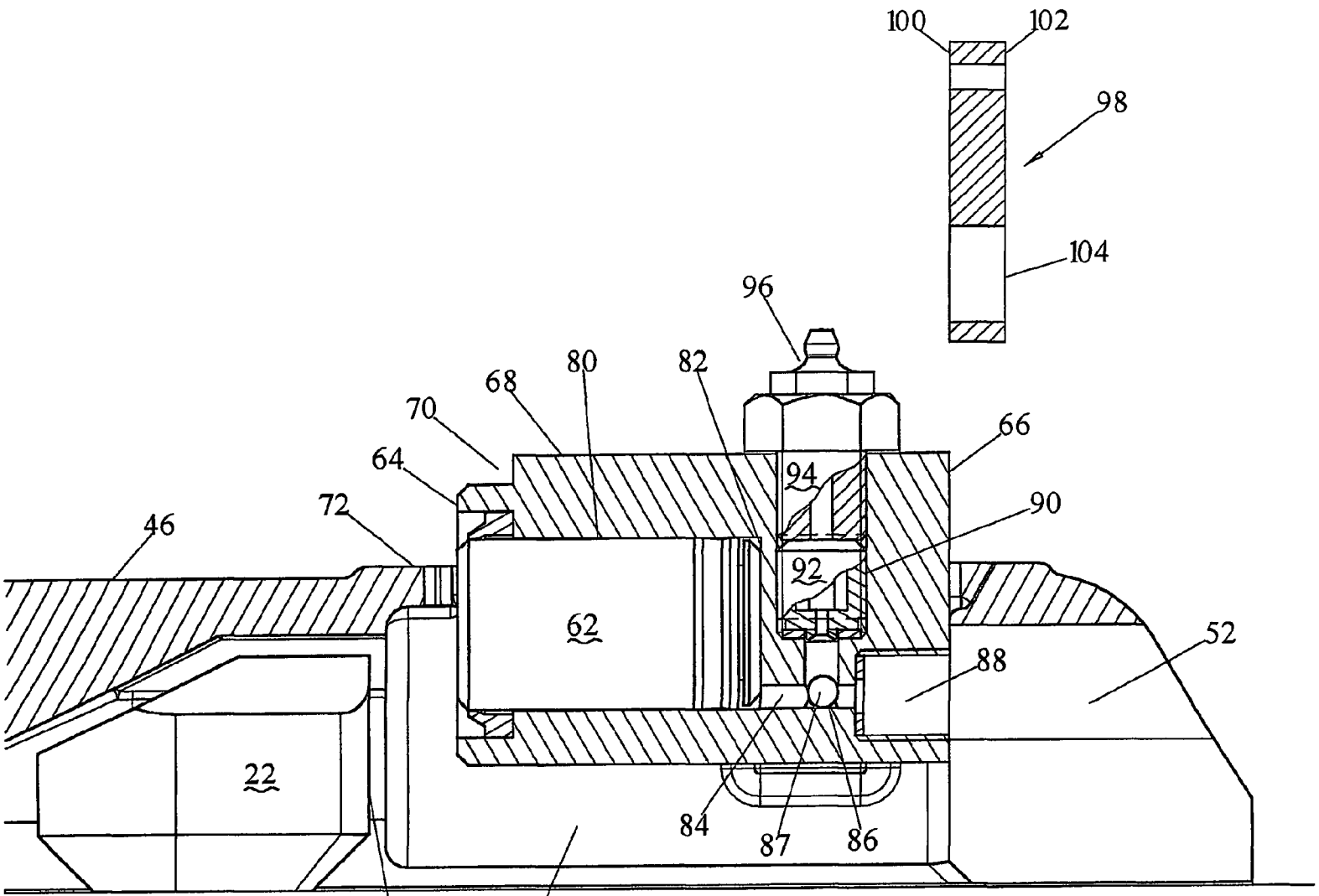
FIG. 4 is a cross sectional view of a portion of the ground engaging tool and lip plate showing the clamping member of FIG. 3, and showing a stabilizing member.
Figure 5:
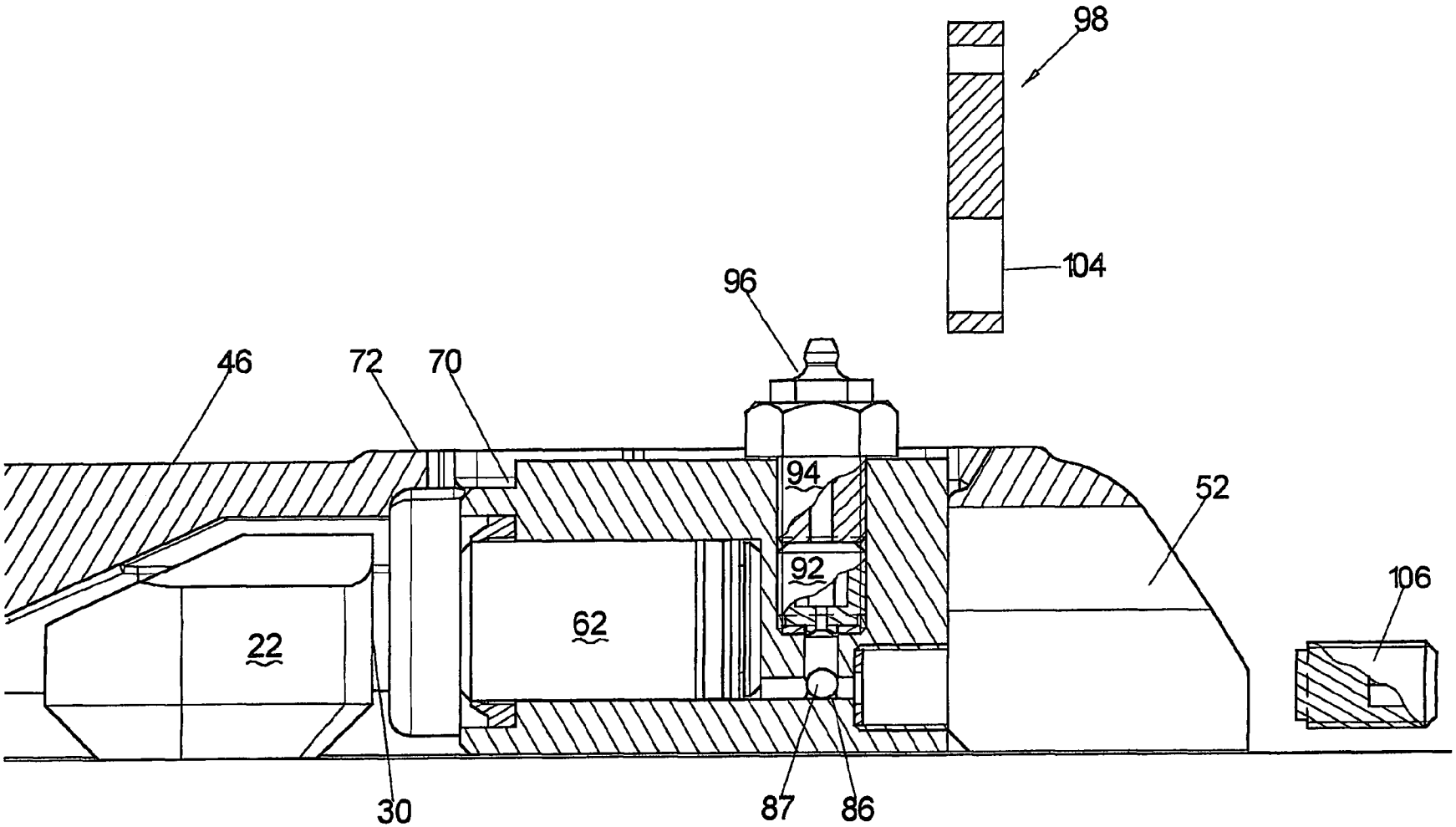
FIGS. 5 to 9 are sequential cross sectional views of the arrangement of FIG. 4 shown during the attachment process.
Figure 6:
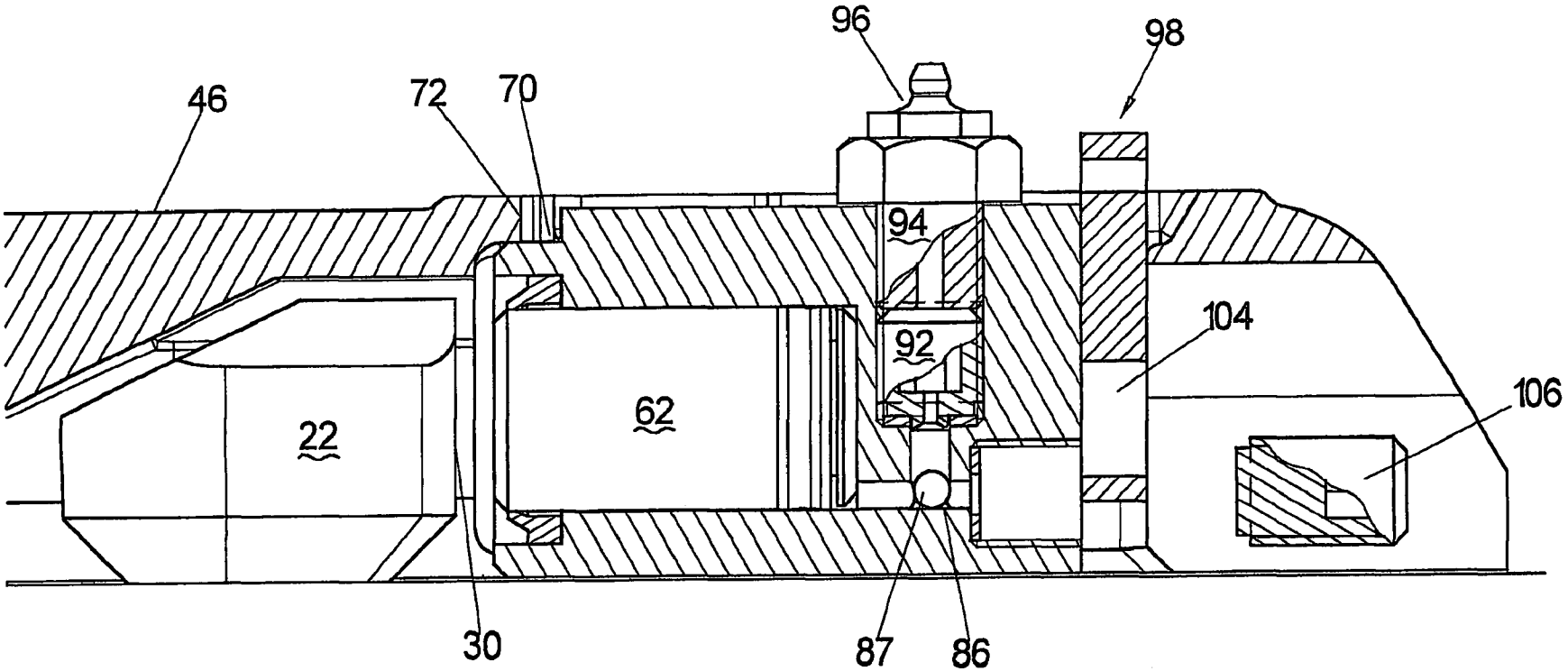
Figure 7:
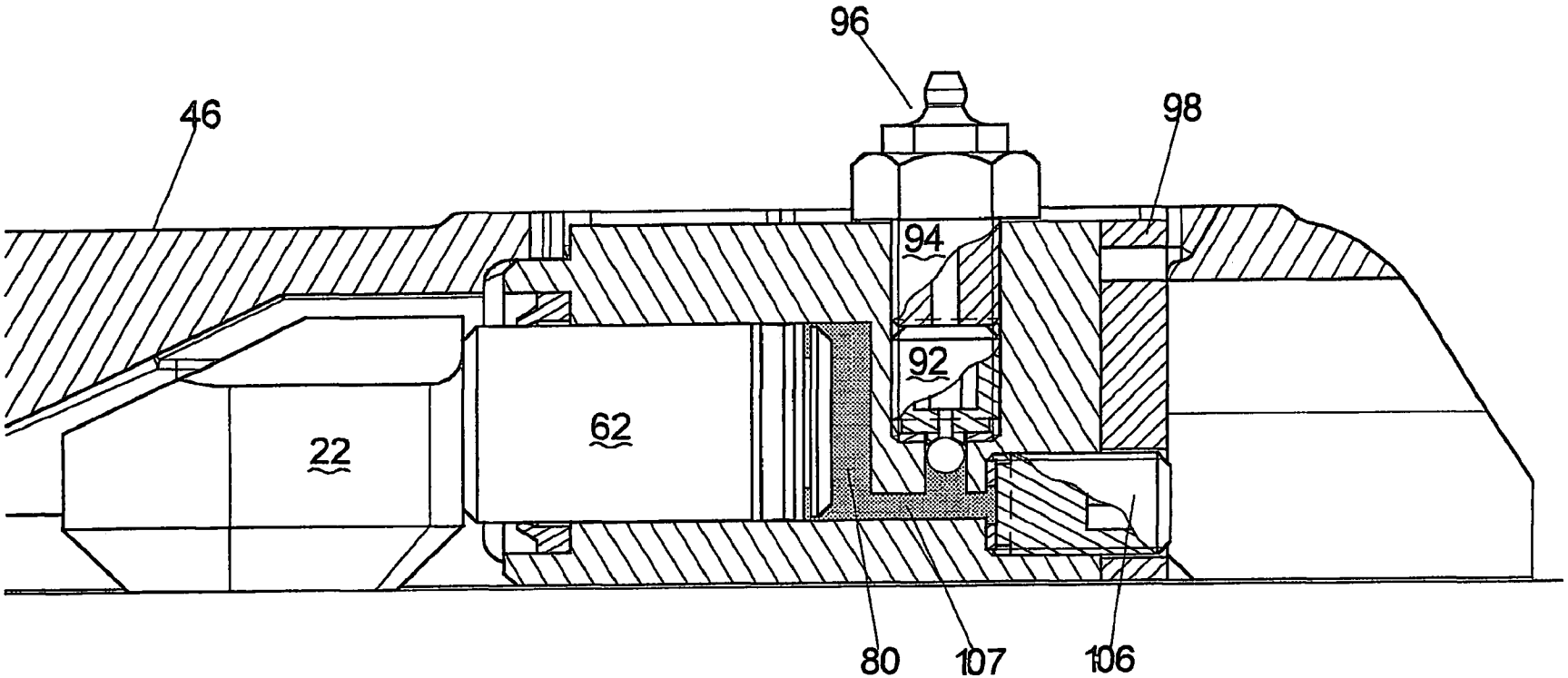
Figure 8:
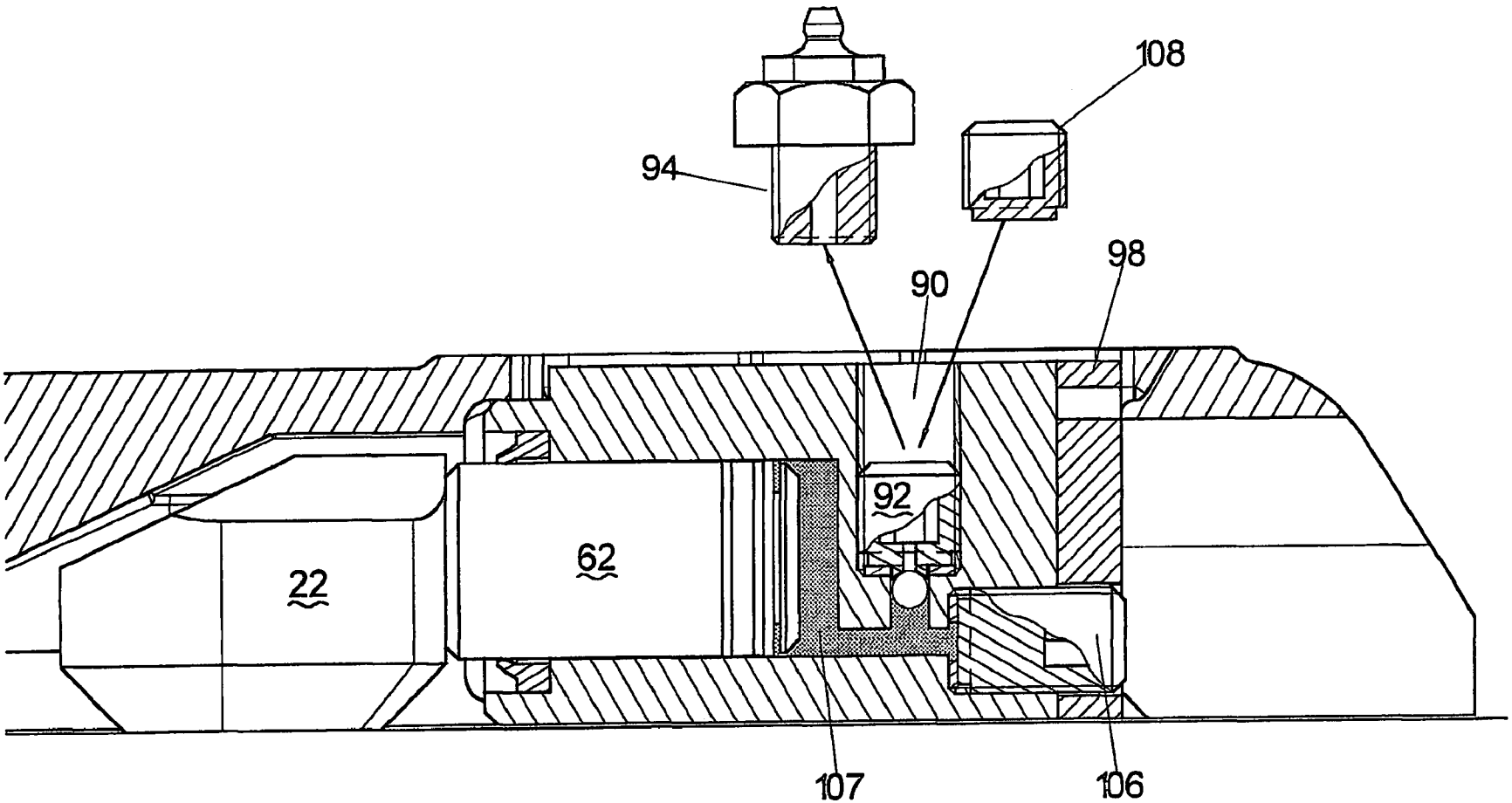
Figure 9:
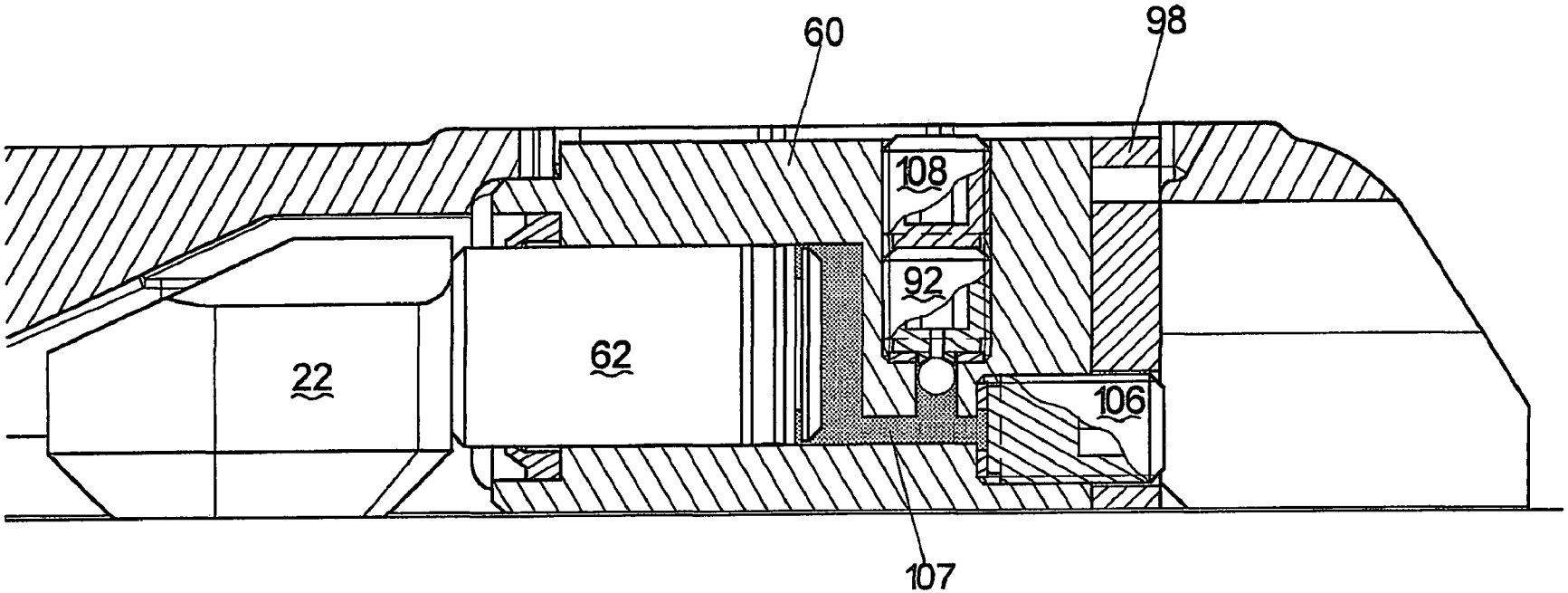

The attachment system further includes a clamping member 60. The clamping member (60) will now be described with respect to a first embodiment of the invention as shown in FIGS. 3 to 9.

The clamping member 60 is of complementary cross section shape to the second portion 56 of the engaging recess 50 and has a first side 64 which is arranged to locate adjacent the lug 22 and a second side 66 opposite the first side 64. The second side 66 is arranged to locate adjacent the rear aperture 52. The clamping member 60 further includes side surfaces 67 and a top surface 68.

The clamping member 60 includes a recessed edge 70 extending between the first side 64 and the top surface 68. The recessed edge 70 is arranged to be complementary in shape to a lip 72 extending from the upper portion 46 of the attachment portion 42 partially above the second portion 56 of the engaging recess 50.

The clamping member 60 includes a substantially cylindrical lug engaging member 62. The lug engaging member 62 is arranged to slide from a first position where it is substantially contained within a chamber 80 within the clamping member 60 to a second position where the lug engaging member 62 extends from the first side 64 of the clamping member 60.

The chamber 80 extends within the clamping member 60 from the first side 64 to a rear wall 82. The chamber 80 is substantially cylindrical in shape, and is complementary in shape to the lug engaging member 62.

A fluid path 84 extends from the rear wall 82 of the chamber 80 to a fluid junction 86 located within the clamping member 60.

A substantially cylindrical fluid outlet 88 extends between the fluid junction 86 and the second side 66 of the clamping member 60.

A substantially cylindrical fluid inlet 90 extends between the fluid junction 86 and the top surface 68 of the clamping member 60.

A substantially cylindrical, hollow first fluid conduit 92, complementary in shape to the fluid inlet 90, is located within the fluid inlet 90 adjacent to the fluid junction 86. The hollow interior of the first fluid conduit 92 is fluidly connected to the fluid junction 86 through a one way valve 87.

A substantially cylindrical, hollow second fluid conduit 94, complementary in shape to the fluid inlet 90, is located within the fluid inlet 90 and extends between the first fluid conduit 92 and the top surface 68. Adjacent the top surface 68 the second fluid conduit 94 has a grease nipple 96. The grease nipple 96 is fluidly connected with the hollow interior of the second fluid conduit 94, which is in turn fluidly connected with the hollow interior of the first fluid conduit 92 and thus the fluid junction 86.

The fluid inlet 90 may be internally threaded, and the first and second fluid conduits 92, 94 externally threaded in complementary fashion.

The attachment system further includes a stabilizing member 98. The stabilizing member 98 is in the form of a prism, having front and rear faces 100, 102 which are substantially the same shape as the cross sectional shape of the second portion 56 of the engaging recess 50.

The stabilizing member 98 has a similar width to the lip 72 of the attachment portion 42.

The stabilizing member 98 has a substantially cylindrical aperture 104 which is arranged to locate, in use, adjacent the fluid outlet 88 of the clamping member 60 so as to form a single cylindrical fluid pathway.

A substantially cylindrical plug 106 is arranged, in use, to locate within the fluid pathway formed by the fluid outlet 88 and the aperture 104 to prevent the flow of fluid from the fluid junction 86 through the fluid outlet 88. The plug 106 may be externally threaded and the fluid outlet 88 internally threaded in complementary fashion. The plug 106 further acts to hold the stabilizing member 98 relative to the clamping member 60 during use.

The use of the clamping member 60 according to the first embodiment will now be described.

The attachment portion 42 is positioned over the lip plate 12 with the lug 22 located within the first portion 54 of the engaging recess 50.

The clamping member 60 is then introduced through the aperture 58. When the clamping member is within the engaging recess 50 it is slid forward relative to the attachment portion 42 such that the recessed edge 70 is engaged by the lip 72.

The clamping member 60 may be provided with channels 69 provided in the side surfaces 67. The channels 69 are arranged to cooperate with side lugs 71 within the second portion 56 of the engaging recess 50 in order to define a track along which the clamping member is slid within the engaging recess 50.

The stabilizing member 98 is then introduced between the second side 66 of the clamping member 60 and the rear aperture 52.

The clamping member is activated as follows. The plug 106 is inserted into the cavity created by the fluid outlet 88 and the aperture 104. A fluid 107 is then introduced under pressure through the grease nipple 96. The fluid 107 is passed through the first and second fluid conduits 92, 94 and the one way valve 87 to the fluid junction 86, and thence through the fluid path to the chamber 80. The effect of the pressure in the chamber 80 is to force the lug engaging member 62 form its first portion to its second position, whereby it engages the rear face 30 of the lug 22. In this way a compressive force is applied between the lug 22 and the attachment portion 42, thus locking the ground engaging tool 10 in position relative to the lip plate 12.

Once the ground engaging tool 10 is thus locked into position, the second fluid conduit 94 along with grease nipple 96 can be removed and replaced with a second plug 108 arranged to fit within the fluid inlet 90. In this way the top surface 46 of the attachment portion 42 is substantially flat. The second plug 108 may be externally threaded if the fluid inlet 90 is internally threaded.

When it is desired to remove the ground engaging tool 10 from the lip portion 12, the plug 106 is removed from the fluid outlet 88. Pressurized fluid (107) can then flow from the chamber 80 through the fluid junction 86 and out through the fluid outlet 88 and aperture 104. The attachment portion 42 can then be readily removed from the lip portion 12 in the reverse of the above process, potentially allowing some members to be reused.

Figure 10:
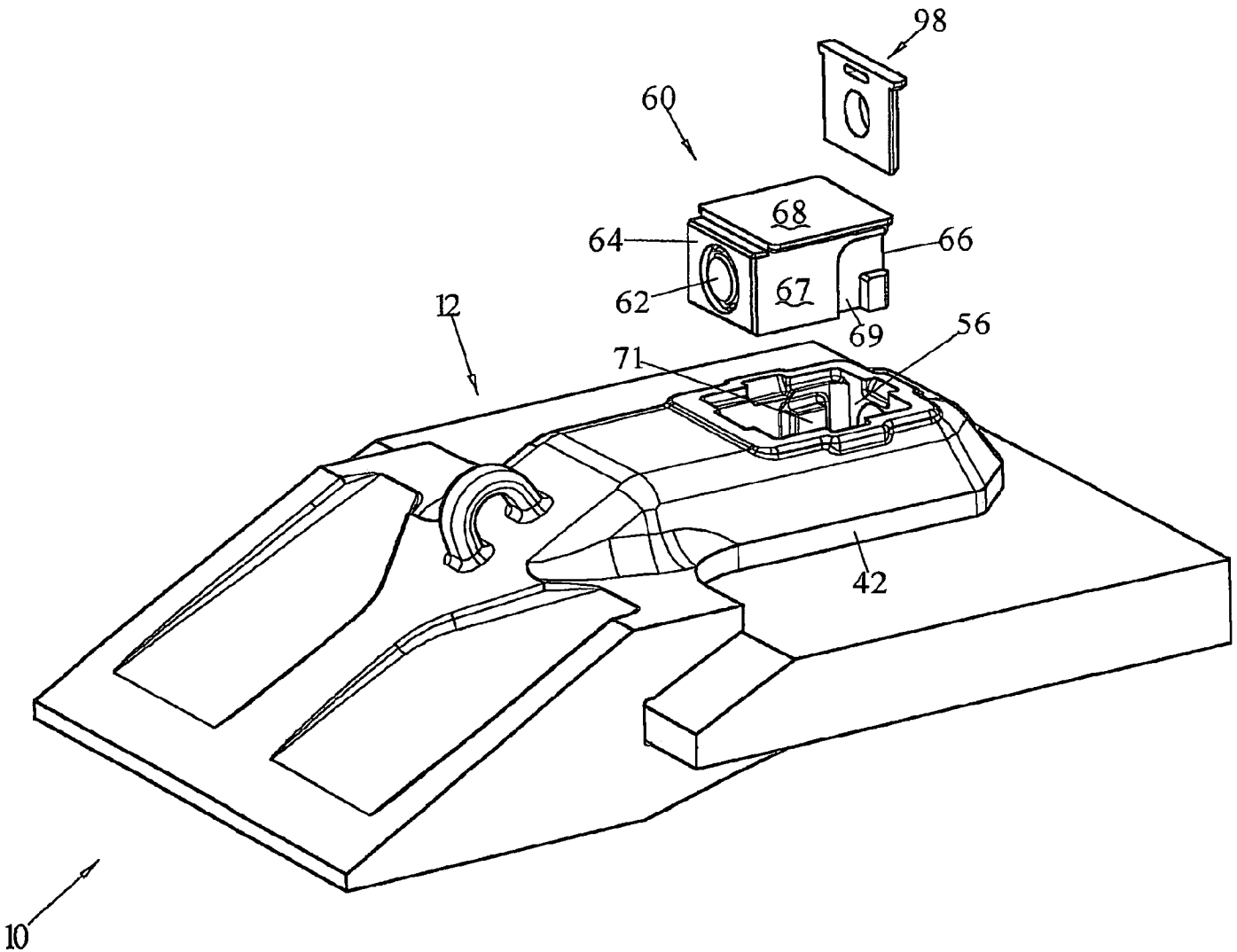
FIG. 10 is a perspective view of the ground engaging tool and lip plate portion of FIG. 1, shown during attachment, together with a clamping member in accordance with a second aspect of the present invention.
Figure 11:
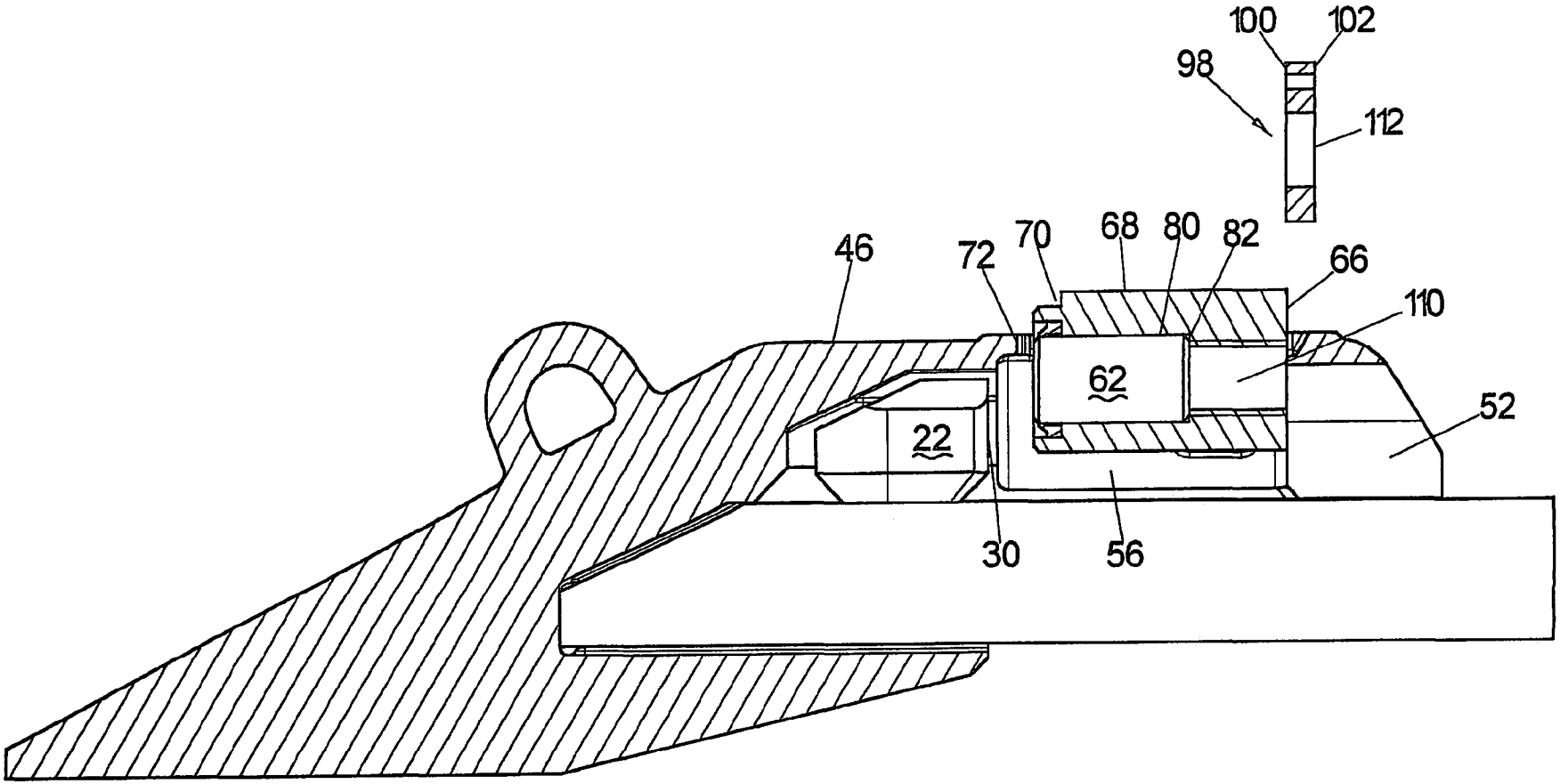
FIG. 11 is a cross section view of a portion of the ground engaging tool and lip plate showing the clamping member of FIG. 10, and showing a stabilizing member.
Figure 12:
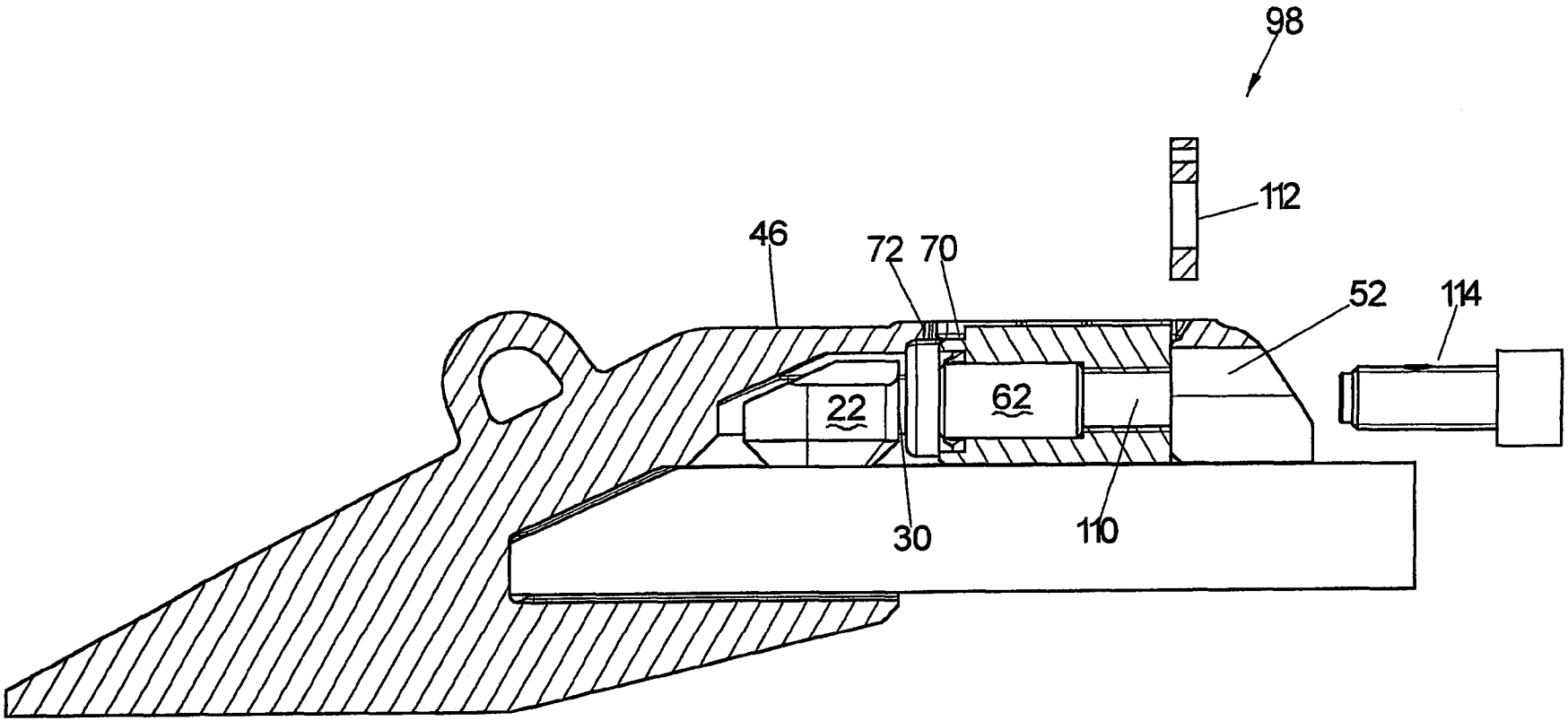
FIGS. 12 and 15 are sequential cross sectional views of the arrangement of FIG. 11 shown during the attachment process.
Figure 13:
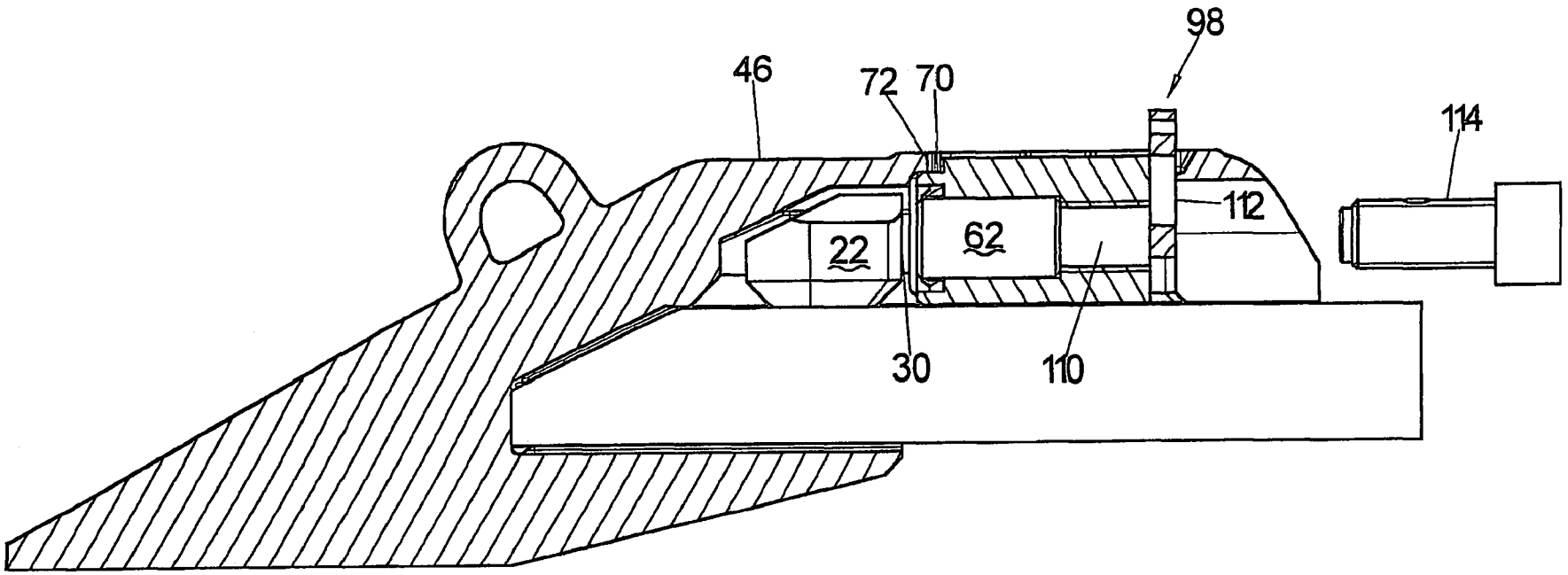
Figure 14:
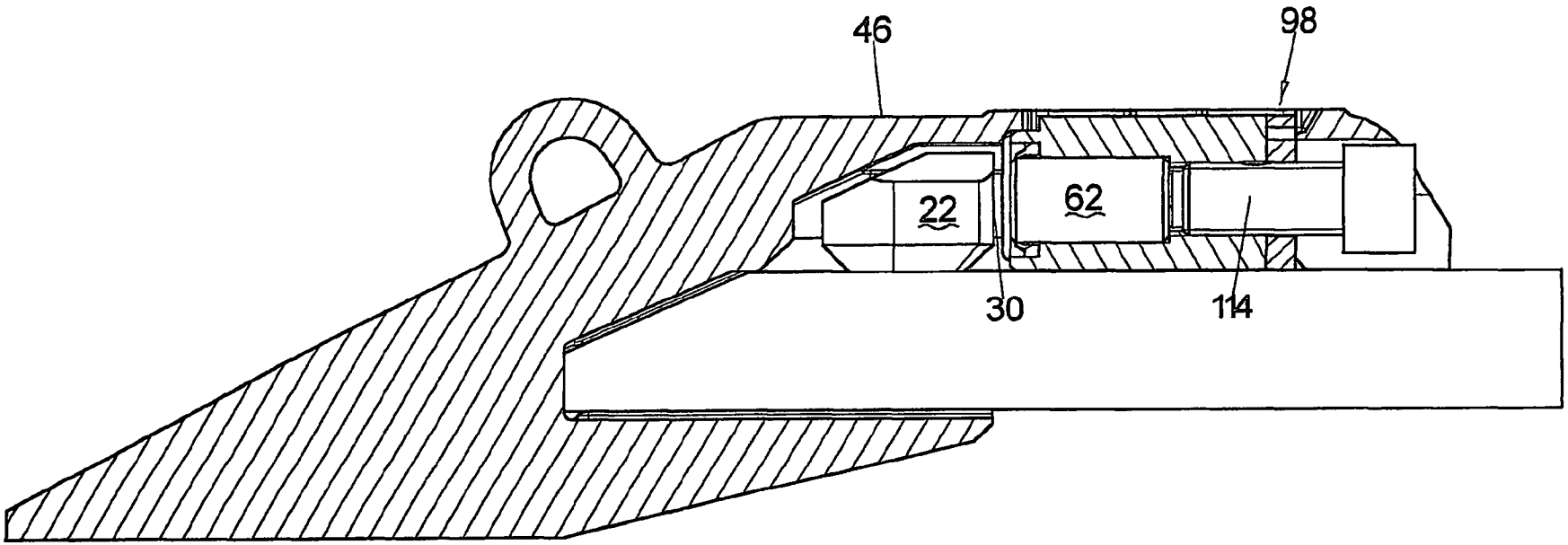
Figure 15:
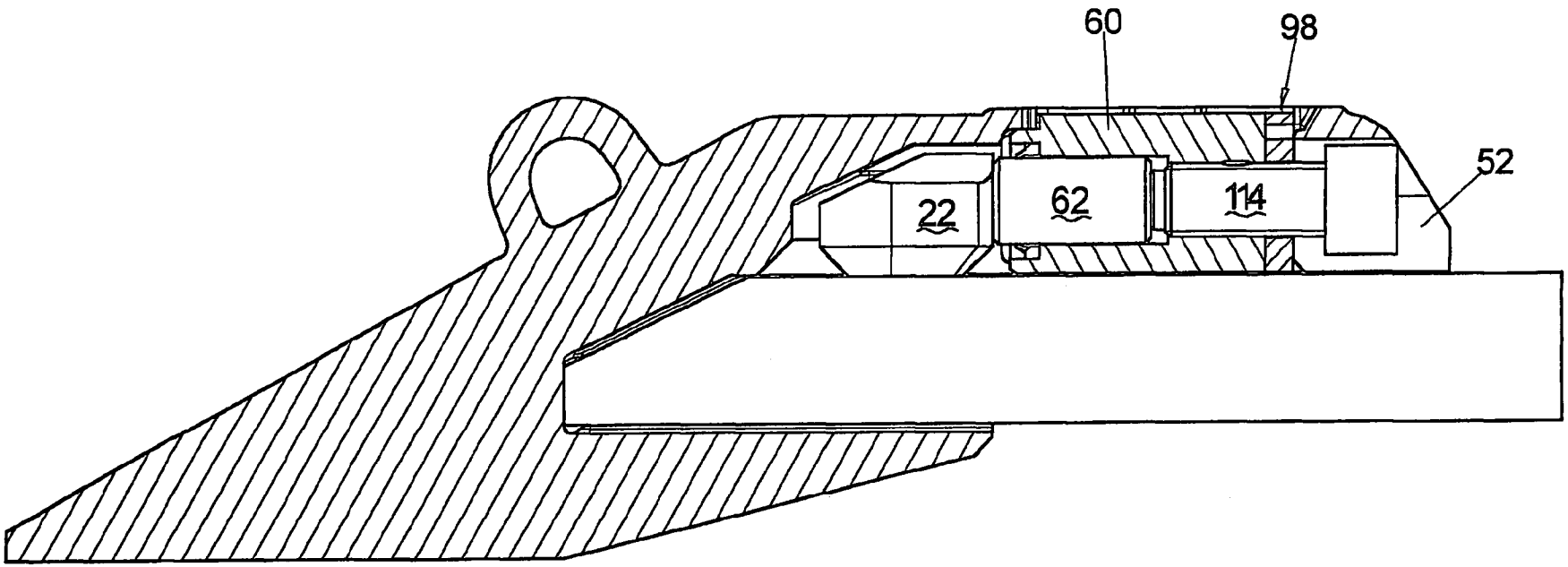

The clamping member (60) will now be described with respect to a second embodiment of the invention as shown in FIGS. 10 to 15, with like numerals denoting like parts.

The clamping member 60 is of complementary cross sectional shape to the second portion 56 of the engaging recess 50 and has a first side 64 which is arranged to locate adjacent the lug 22 and a second side 66 opposite the first side 64. The second side 66 is arranged to located adjacent the rear aperture 52. The clamping member 60 further includes side surfaces 67 and a top surface 68.

The clamping member 60 includes a recessed edge 70 extending between the first side 64 and the top surface 68. The recessed edge 70 is arranged to be complementary in shape to a lip 72 extending from the upper portion 46 of the attachment member 42 partially above the second potion 56 of the engaging recess 50.

The clamping member 60 includes a substantially cylindrical lug engaging member 62. The lug engaging member 62 is arranged to slide from a first position where it is fully contained within a chamber 80 within the clamping member 60 to a second position where the lug engaging member 62 extends from the first side 64 of the clamping member 60.

The chamber 80 extends within the clamping member 60 from the first side 64 to a rear wall 82. The chamber 80 is substantially cylindrical in shape, and is complementary in shape to the lug engaging member 62.

A substantially cylindrical slot 110 extends from the chamber 80 adjacent a rear end of the lug engaging member 62 to the second side 66 of the clamping member 60. The slot 110 is internally threaded.

The attachment system further includes a stabilizing member 98. The stabilizing member 98 is in the form of a prism, having front and rear faces 100, 102 which are substantially the same shape as the cross sectional shape of the second portion 56 of the engaging recess 50.

The stabilizing member 98 has a similar width to the lip 72 of the attachment portion 42.

The stabilizing member 98 has a substantially cylindrical aperture 112 which is arranged to locate, in use, adjacent the slot 110 of the clamping member 60 so as to form a single cylindrical passageway.

A forcing member in the form of a substantially cylindrical bolt 114 is arranged, in use, to locate within the passageway formed by the slot 110 and the aperture 112. The bolt is externally threaded, and is arranged to engage with the internally threaded slot 110. The bolt acts to hold the stabilizing member 98 relative to the clamping member 60 during use.

The use of the clamping member 60 according to the second embodiment will now be described.

The attachment portion 42 is positioned over the lip plate 12 with the lug 22 located within the first portion 54 of the engaging recess 50.

The clamping member 60 is then introduced through the aperture 58. When the clamping member is within the engaging recess 50 it is slid forward relative to the attachment portion 42 such that the recessed edge 70 is engaged by the lip 72. The clamping member 60 may be provided with channels 69 provided in the side surfaces 67. The channels 69 are arranged to cooperate with side lugs 71 within the second portion 56 of the engaging recess 50 in order to define a track along which the clamping member is slid within the engaging recess 50.

The stabilizing member 98 is then introduced between the second side 66 of the clamping member 60 and the rear aperture 52.

The clamping member is activated as follows. The bolt 114 is introduced into the passage created by the slot 110 and the aperture 112, and is threadedly engaged with the slot 110. When the bolt 114 is fully within this passage, the end of the bolt 114 is adjacent the lug engaging member 62. The application of a turning force to the bolt so as to promote the further advance of the bolt into the chamber 80 provides a pressing force on the lug engaging member 62.

The effect of the pressure in the chamber 80 is to force the lug engaging member 62 from its first position to its second position, whereby it engages the rear face 30 of the lug 22. In this way a compressive force is applied between the lug 22 and the attachment portion 42, thus locking the ground engaging tool 10 in position relative to the lip plate 12.

When it is desired to remove the ground engaging tool 10 from the lip portion 12, the bolt 114 is unscrewed from the slot 110, thus releasing pressure from the lug engaging portion 62. The attachment portion 42 can then be readily removed from the lip portion 12 in the reverse of the above process, potentially allowing some members to be reused.

Modifications and variations as would be apparent to a skilled addressee are deemed to be within the scope of the present invention.

The invention claimed is:

1. An attachment system, comprising:

a first member including a surface and a lug projecting from the surface;

a second member including a recess having a first portion and a second portion, the second portion of the recess arranged to initially receive the lug and the first portion of the recess arranged to receive the lug from the second portion of the recess;

a clamping member disposed in the recess of the second member between the lug and the second member; and a pressure applying unit to apply pressure to the clamping member so that the clamping member acts to restrain disengagement of the lug from the first portion of the recess in the second member.

2. An attachment system according to claim 1, wherein the first member is a lip plate of a digging device and the second member is a ground engaging tool.

3. An attachment system according to claim 2, wherein the ground engaging tool has an attachment portion and a working portion and wherein the recess is within the attachment portion.

4. An attachment system according to claim 1, wherein the first portion has a cross section that is substantially shaped as an inverted U.

5. An attachment system according to claim 1, wherein the second portion has a larger cross sectional dimension than the first portion, such that the lug can be loosely received in the second portion and the clamping member can not be received in the first portion.

6. An attachment system according to claim 1, wherein the clamping member includes a lug engaging member which is moveable between a first position whereby the lug engaging member is substantially contained within a chamber in the clamping member and a second position whereby the lug engaging member extends from a first side of the clamping member.

7. An attachment system according to claim 6, wherein the lug engaging member engages the lug when in the second position.

8. An attachment system according to claim 7, wherein the lug is engaged by the lug engaging member all forces transferred between the claimping member and the lug act through the lug engaging member.

9. An attachment system according to claim 6, wherein upon supply of pressure thereto, the clamping member causes the lug engaging member to move between the first position and the second position.

10. An attachment system accoding to claim 9, wherein the pressure applying unit is arranged to supply fluid pressure.

11. An attachment system according to claim 10, wherein the chamber is fluidly connected to a fluid inlet.

12. An attachment system according to claim 11, wherein the chamber is fluidly connected to a grease nipple contained within the fluid inlet.

13. An attachment system according to claim 12, wherein the grease nipple is removable from the clamping member.

14. An attachment system according to claim 12, wherein the chamber includes a one way valve arranged to prevent flow of fluid from the chamber to the fluid inlet.

15. An attachment system according to claim 10, wherein the chamber is fluidly connected to a fluid outlet and includes a plug within the fluid outlet arranged to prevent the flow of fluid through the fluid outlet.

16. An attachment system according to claim 9, wherein the pressure applying unit is arranged to supply mechanical pressure.

17. An attachment system according to claim 16, wherein the clamping member includes a slot extending from the chamber, and a forcing member is arranged to be located in the slot.

18. An attachment system as claimed in claim 17, characterised in that the forcing member is arranged to be threadedly engaged within the slot, and is arranged to supply pressure upon the application of a torque thereto.

19. An attachment system according to claim 1, further including a stabilizing member located between the clamping member and the second member so as to restrict the movement of the clamping member within the recess.

20. An attachment system according to claim 1, wherein the clamping member has a recessed edge and the recess has a lip arranged to engage the recessed edge of the clamping member and so prevent movement of the clamping member away from the recess.

21. An attachment system according to claim 20, wherein the recessed edge is at a front edge of the clamping member.

22. An attachment system according to claim 1, wherein the recess has a side wall, the side wall has a side lug protruding therefrom, and the clamping member has a channel arranged such that the channel defines a track along which the side lug can move.

23. An attachment system according to claim 1, wherein the lug is arranged to receive only compressive forces from the second member and the clamping member.

24. The attachment system of claim 1, wherein the clamping member is disposed solely in the recess of the second member.

25. The attachment system of claim 1, wherein the second portion of the recess is arranged to initially receive the lug in a first direction and the first portion of the recess is arranged to receive the lug from the second portion in a second direction different from the first direction.

* * * * *